US008201543B2

(12) United States Patent
Morris et al.

(10) Patent No.: US 8,201,543 B2
(45) Date of Patent: Jun. 19, 2012

(54) PIEZOELECTRIC DIRECT ACTING FUEL INJECTOR WITH HYDRAULIC LINK

(75) Inventors: Corydon E. Morris, Columbus, IN (US); Bela Doszpoly, Columbus, IN (US); Gary L. Gant, Columbus, IN (US)

(73) Assignee: Cummins Intellectual Properties, Inc., Minneapolis, MN (US)

( * ) Notice: Subject to any disclaimer, the term of this patent is extended or adjusted under 35 U.S.C. 154(b) by 623 days.

(21) Appl. No.: 12/466,026

(22) Filed: May 14, 2009

(65) Prior Publication Data

US 2010/0288239 A1 Nov. 18, 2010

(51) Int. Cl.
*F02M 51/00* (2006.01)
*B05B 1/08* (2006.01)

(52) U.S. Cl. ..... 123/494; 123/498; 239/102.2

(58) Field of Classification Search ..... 123/494, 123/496, 498; 239/102.1, 102.2, 533.2, 533.3, 239/585.1–585.5; 251/129.15, 129.21, 129.06
See application file for complete search history.

(56) References Cited

U.S. PATENT DOCUMENTS

| | | | |
|---|---|---|---|
| 3,680,782 | A | 8/1972 | Monpetit et al. |
| 4,545,352 | A | 10/1985 | Jourde et al. |
| 4,728,074 | A | 3/1988 | Igashira et al. |
| 4,782,807 | A | 11/1988 | Takahashi |
| 4,798,186 | A | 1/1989 | Ganser |
| 4,826,080 | A | 5/1989 | Ganser |
| 5,860,597 | A | 1/1999 | Tarr |
| 6,253,736 | B1 | 7/2001 | Crofts et al. |
| 6,298,829 | B1 | 10/2001 | Welch et al. |
| 6,390,385 | B1 | 5/2002 | Hardy et al. |
| 6,499,467 | B1 | 12/2002 | Morris et al. |
| 6,520,423 | B1 | 2/2003 | Ricci-Ottati et al. |
| 6,550,455 | B2 | 4/2003 | Carroll, III et al. |
| 6,575,138 | B2 | 6/2003 | Welch et al. |
| 6,676,030 | B2 | 1/2004 | Lorraine et al. |

(Continued)

FOREIGN PATENT DOCUMENTS

EP 0967382 B1 11/2004

(Continued)

OTHER PUBLICATIONS

The Notification of Transmittal of the International Search Report and the Written Opinion of the International Searching Authority, or the Declaration with mailing date of Feb. 9, 2011; International Application No. PCT/US2010/030513.

*Primary Examiner* — Hieu T Vo
(74) *Attorney, Agent, or Firm* — Studebaker & Brackett PC; Tim L. Brackett, Jr.

(57) ABSTRACT

A piezoelectric-actuated fuel injector for injecting fuel into a combustion chamber of an internal combustion engine is provided which includes a piezoelectric actuator movable to expand in a first direction and movable to contract in a second direction opposite the first direction, and a hydraulic link assembly disposed within said injector cavity. The hydraulic link assembly includes a hydraulic link barrel having an inner bore, a hydraulic link outer plunger positioned to slidably move in the inner bore, and a hydraulic link operatively connected to a needle valve to move the needle valve in the second direction toward the open position in response to movement of the piezoelectric actuator in the first direction. A hydraulic link inner plunger is attached to the needle valve and extends into a center bore of the hydraulic link outer plunger. Leakage control features and hydraulic link refill valves are also provided.

23 Claims, 8 Drawing Sheets

U.S. PATENT DOCUMENTS

| | | | | |
|---|---|---|---|---|
| 6,676,035 | B2 | 1/2004 | Lorraine et al. | |
| 6,685,105 | B1 * | 2/2004 | Ruehle et al. | 239/102.1 |
| 6,739,528 | B2 | 5/2004 | Lorraine et al. | |
| 6,776,354 | B2 | 8/2004 | Cooke | |
| 6,883,725 | B2 * | 4/2005 | Hohl et al. | 239/102.2 |
| 6,948,667 | B2 | 9/2005 | Eichendorf | |
| 6,978,770 | B2 | 12/2005 | Rauznitz et al. | |
| 7,066,399 | B2 * | 6/2006 | Hohl | 239/102.2 |
| 7,073,730 | B2 | 7/2006 | Haag et al. | |
| 7,077,115 | B2 | 7/2006 | Weber et al. | |
| 7,140,353 | B1 | 11/2006 | Rauznitz et al. | |
| 7,258,283 | B2 | 8/2007 | Heinz et al. | |
| 7,353,806 | B2 | 4/2008 | Gant | |
| 7,431,220 | B2 * | 10/2008 | Kanne et al. | 123/498 |
| 7,451,938 | B2 | 11/2008 | Cooke | |

FOREIGN PATENT DOCUMENTS

| | | |
|---|---|---|
| WO | 02095212 | 11/2002 |

* cited by examiner

PIEZOELECTRIC DIRECT ACTING FUEL INJECTOR WITH HYDRAULIC LINK

TECHNICAL FIELD

The present invention relates generally to fuel injection systems and, more particularly, to a fuel system and method for improved piezoelectric injection systems.

BACKGROUND OF THE INVENTION

In many fuel supply systems applicable to internal combustion engines, fuel injectors are used to inject fuel pulses into the engine combustion chamber. A commonly used injector is a closed-nozzle injector which includes a nozzle assembly having a spring-biased nozzle valve element positioned adjacent the nozzle orifice for allowing fuel to be injected into the cylinder. The nozzle valve element also functions to provide a deliberate, abrupt end to fuel injection, thereby preventing a secondary injection which causes unburned hydrocarbons in the exhaust. The nozzle valve is positioned in a nozzle cavity and biased by a nozzle spring so that when an actuated force exceeds the biasing force of the nozzle spring, the nozzle valve element moves to allow fuel to pass through the nozzle orifices, thus marking the beginning of the injection event.

Internal combustion engine designers have increasingly come to realize that substantially improved fuel supply systems are required in order to meet the ever increasing governmental and regulatory requirements of emissions abatement and increased fuel economy. As such, one aspect of fuel supply systems that has been the focus of designers is the use of piezoelectric actuators in fuel injectors.

In general, piezoelectric actuators have long been recognized as highly desirable for use in systems requiring extremely fast mechanical operation in response to an electrical control signal. For this reason, piezoelectric actuators have received considerable attention by designers of fuel supply systems for internal combustion engines. Such designers are continually searching for ways to obtain faster, more precise, reliable, and predictable control over the timing and quantity of successive fuel injections into the combustion chambers of internal combustion engines to help meet the economically and governmentally mandated demands for increasing fuel economy and reduced air pollution. If such goals are to be attained, fuel control valves must be designed to provide extremely fast and reliable response times.

SUMMARY OF THE INVENTION

The various advantages of the present invention may be achieved by providing a piezoelectric-actuated fuel injector for injecting fuel into a combustion chamber of an internal combustion engine, comprising an injector body containing an injector cavity and an injector orifice communicating with one end of said injector cavity to discharge fuel into the combustion chamber, a needle valve positioned in one end of the injector cavity adjacent the injector orifice. The needle valve is movable between an open position in which fuel flows from the fuel supply circuit through the injector orifice into the combustion chamber and a closed position in which fuel flow through the injector orifice is blocked. A piezoelectric actuator is provided which includes a stack of piezoelectric elements movable to expand in a first direction and movable to contract in a second direction opposite the first direction. A hydraulic link assembly is disposed within the injector cavity and includes a hydraulic link barrel having an inner bore, a hydraulic link outer plunger positioned to slidably move in the inner bore and operably connected to the piezoelectric actuator, and a hydraulic link positioned between the hydraulic link barrel and the hydraulic link outer plunger. The hydraulic link is operatively connected to the needle valve to move the needle valve in the second direction toward the open position in response to movement of the stack of piezoelectric elements in the first direction.

The hydraulic link outer plunger may include a center bore and the hydraulic link assembly may further include a hydraulic link inner plunger rigidly attached to the outer end of the needle valve and extending into the center bore. The hydraulic link outer plunger, hydraulic link inner plunger and hydraulic link barrel may be positioned in overlapping relationship. The hydraulic link may be formed around the hydraulic link inner plunger and between one end of the hydraulic link outer plunger and the hydraulic link barrel. A leakage control feature may be provided which includes an annular channel disposed in an interior surface of the hydraulic link barrel and extending around the hydraulic link inner plunger to receive pressurized fuel. The injector may further include an actuator plunger operatively connecting the piezoelectric actuator to the hydraulic link outer plunger, and a leakage control feature comprising an annular channel disposed in a surface of the injector body and surrounding the actuator plunger to receive pressurized fuel.

The fuel injector may also include a hydraulic link return spring disposed between an end of the hydraulic link barrel and a surface of the hydraulic link outer plunger to provide a biasing force to the hydraulic link outer plunger. A needle valve stop may be positioned longitudinally along the fuel injector between the hydraulic link assembly and the injector orifice to limit the movement of the needle valve toward the open position. The fuel injector may further include an actuator plunger operatively connecting the piezoelectric actuator to the hydraulic link outer plunger, the injector body including a bore positioned to receive the actuator plunger and a valve seat extending around the bore. The actuator plunger may include a sealing valve adapted to move into a closed position when the stack of piezoelectric elements contracts in the second direction to block leakage flow into the bore and into a open position when the stack of piezoelectric elements expands in the first direction.

The hydraulic link may be positioned in a hydraulic link chamber and the injector may include a hydraulic link refill valve operable to permit fuel into the hydraulic link chamber while preventing fuel flow from the hydraulic link chamber. The hydraulic link refill valve may be positioned within the hydraulic link barrel. The hydraulic link refill valve may include a refill valve body mounted for slidable movement on the hydraulic link inner plunger and a valve seat formed on the hydraulic link barrel. A refill valve stop may be formed on the hydraulic link inner plunger. Preferably, an annular gap is positioned radially between the hydraulic link barrel and the injector body for receiving high pressure fuel. The hydraulic link barrel may be biased in one axial direction by a return spring, and movable transversely. A valve chamber may be formed in the hydraulic link outer plunger and a valve positioned in the valve chamber to restrict fuel flow out of the valve chamber to restrict movement of the needle valve in the second direction.

The present invention also provides a piezoelectric-actuated fuel injector for injecting fuel into a combustion chamber of an internal combustion engine, comprising a piezoelectric actuator including a stack of piezoelectric elements movable to expand in a first direction and movable to contract in a second direction opposite the first direction and a hydraulic link assembly disposed within an injector cavity and including a hydraulic link barrel having an inner bore and an outer surface radially spaced from the injector body to form an annular gap between the outer surface and the injector body to receive high pressure fuel. The hydraulic link assembly further includes a hydraulic link outer plunger positioned to slidably move in the inner bore, operably connected to a piezoelectric actuator, and including a center bore. The hydraulic link assembly further includes a hydraulic link inner plunger attached to the outer end of a needle valve and extending into the center bore of the hydraulic link outer plunger, and a hydraulic link chamber positioned axially between the hydraulic link barrel and the hydraulic link outer plunger.

DETAILED DESCRIPTION OF THE INVENTION

Figure 1A:
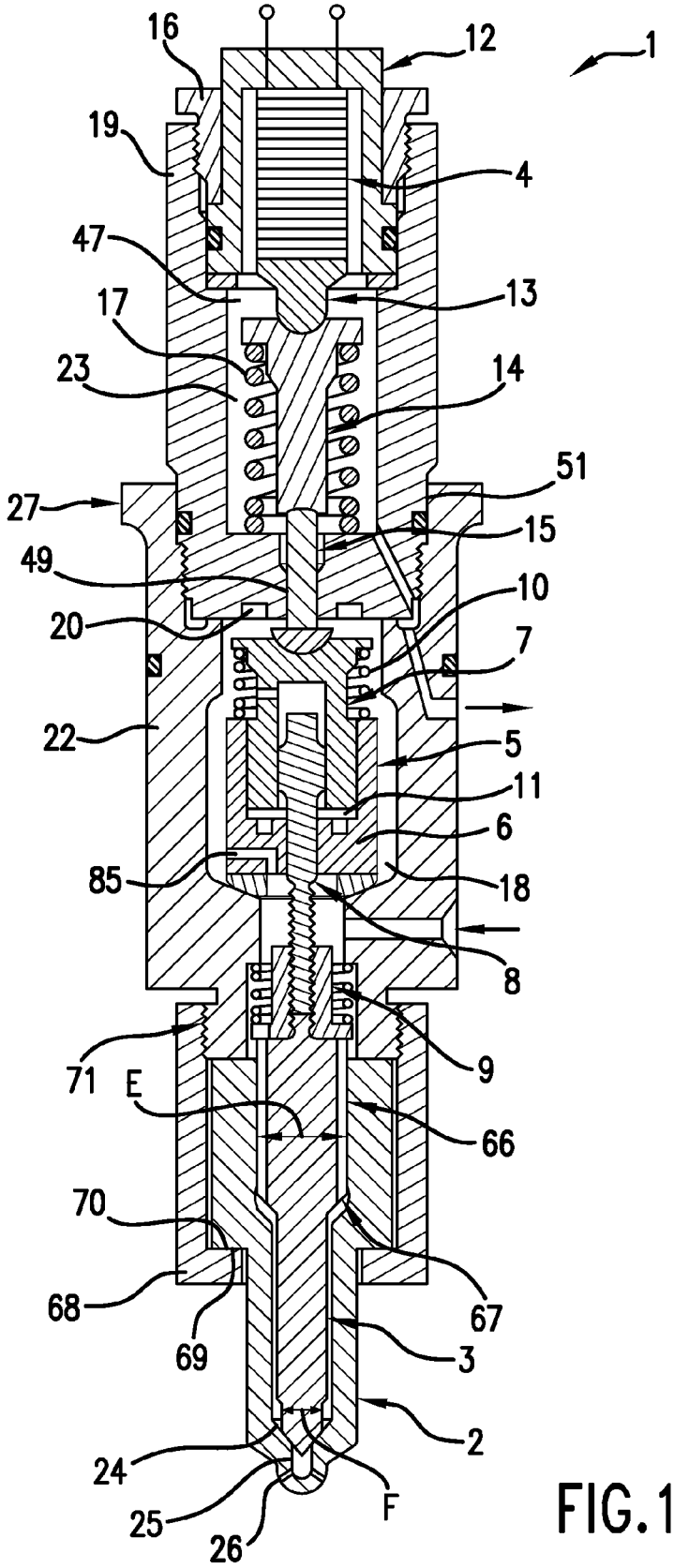
FIG. 1A provides a schematic illustration of a piezoelectric actuated fuel injector according to an exemplary disclosed embodiment.

Piezoelectric devices are capable of extremely fast and reliable valve response times. As a result, they offer greater control over fuel delivery, because they can be used to inject required amounts of fuel in a short time frame. The time frame for injecting fuel can be shortened by injecting the fuel at higher injection pressures. For instance, applicant has implemented extra high pressure injection systems where the pressures can reach 2400 bar. Such high injection pressures create smaller fuel droplets and higher injection velocity to promote more complete burning of the fuel, which maximizes power and increases fuel economy. In addition, pollution is minimized because the high thermal efficiencies result in low emissions of hydrocarbons (HC) and carbon monoxide (CO). By injecting required amounts of fuel in a shorter time frame, a high pressure system can accommodate multiple injection events during each combustion cycle. As a result, the engine control software can optimize combustion for particular conditions.

Applicant has recognized that the use of very high injection pressures, however, requires piezoelectric actuators of conventional fuel injectors to operate with correspondingly high force levels. In general, piezoelectric actuators must act against the high pressure fuel in the fuel injector to move the nozzle valve into an open position causing the injection of fuel. For instance, in one type of fuel injector design, a control chamber filled with high pressure fuel is employed to bias the nozzle valve in the closed position against the force of a spring, and the piezoelectric actuator opens a control valve to expose the control chamber to a low pressure drain. When the fuel drains from the control chamber, the pressure in the control chamber drops and is no longer able to keep the nozzle valve in the closed position. In order to open the control valve, the piezoelectric actuator must act against the high pressure in the control chamber. Thus, piezoelectric actuators in such fuel injectors must provide large forces due to the high pressure which exists in the fuel injector. Accordingly, the design of conventional piezoelectric actuators is dependent on the injector pressures. High pressure injection fuel injectors are required to use larger piezoelectric actuators to supply the necessary forces. Moreover, more power is required to operate conventional piezoelectric actuators with high injection pressures.

Applicant has also recognized that the performance of conventional piezoelectric actuators is also affected by environmental and operational factors, such as temperature. When used as a valve actuator, piezoelectric devices are known to provide extremely fast, reliable characteristics when calibrated to and operated at a relatively constant temperature. However, internal combustion engines are required to operate reliably over an extremely broad ambient temperature range. Moreover, fuel injection valves mounted directly on the engine are subjected to an even broader range of temperatures since the operating temperatures of an internal combustion engine may extend well above ambient temperatures and may reach 140° C. or more. Such temperature extremes can produce wide variations in the operating characteristics (e.g. length of stroke and/or reaction time) of a piezoelectric actuator. Conventional piezoelectric injectors experience shifts in fueling due to temperature and the difference in the thermal expansion between the piezo ceramic and the material used to mount the piezo. In particular, the ceramic thermal coefficient of expansion is much lower than that of steel. Because the useable stroke of a piezoelectric actuator is in the 30 to 40 micron range, the thermal effects can exceed the stroke. Such actuator variations can lead to wide variations in timing and quantity of injected fuel when the piezoelectric actuator is used to control fuel injection into an internal combustion engine.

Figure 1B:
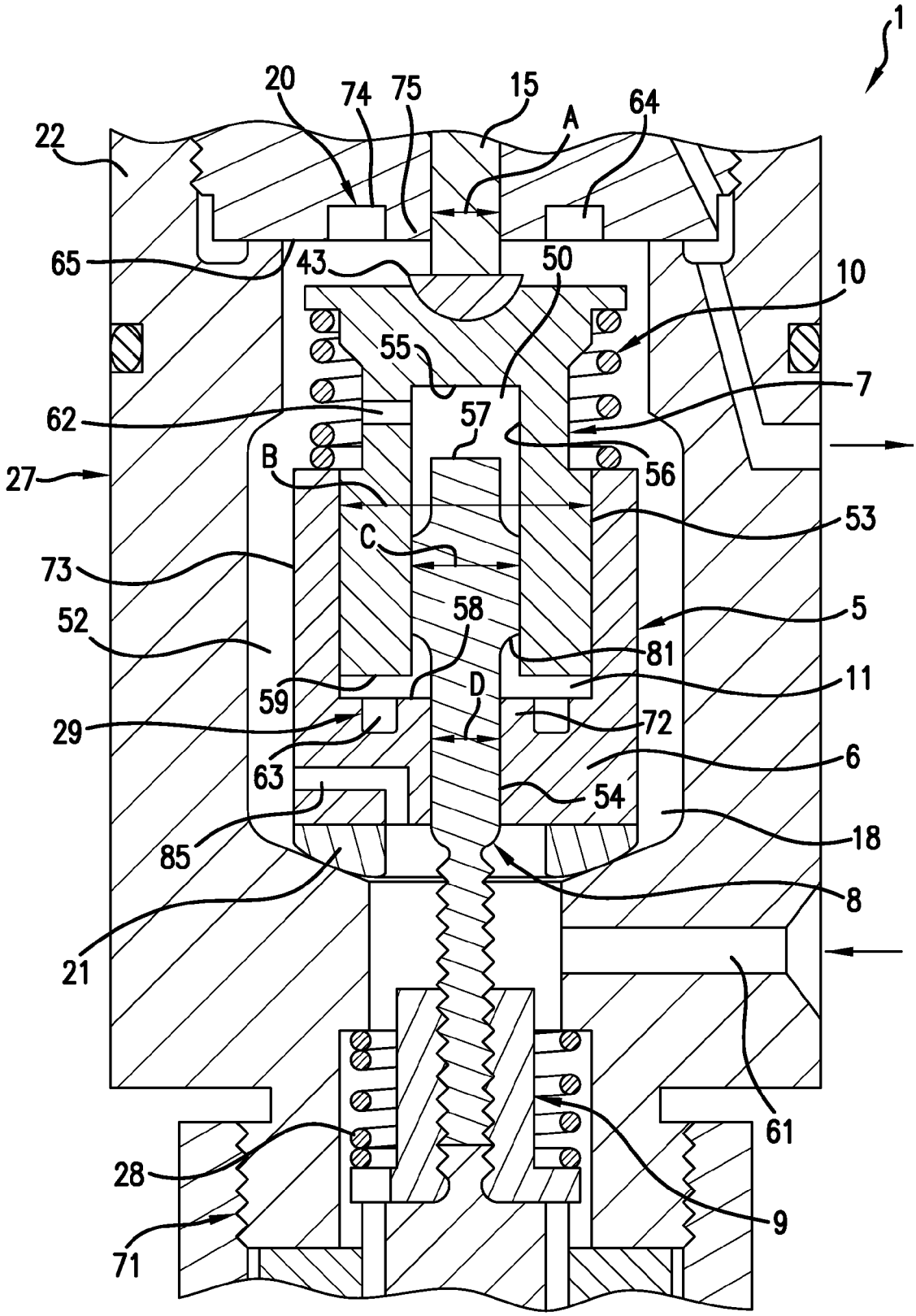
FIG. 1B is a an enlarged view of a hydraulic link assembly of the piezoelectric actuated fuel injector of FIG. 1A.

FIGS. 1A and 1B illustrate a piezoelectric actuated fuel injector 1 according to an exemplary embodiment of the present invention designed to overcome one or more shortcomings of conventional injectors, including the shortcomings noted above and/or offer advantages noted hereinbelow. Accordingly, FIGS. 1A and 1B show a piezoelectric actuated fuel injector 1 generally including a nozzle 2, a needle valve 3, a piezoelectric actuator 4, and a hydraulic link assembly 5. An injector body 27 includes an injector barrel 22 and actuator housing 19 for receiving a plurality of components therein. The disclosed embodiment provides an inner cavity 47 within the actuator housing 19 for receiving piezoelectric actuator 4, an actuator adapter 13, an actuator link 14, an actuator plunger 15, and an actuator pre-load spring 17. Inner cavity 47 is a low pressure environment of piezoelectric actuated fuel injector 1 relative to the high pressure environment below actuator plunger 15.

The upper end of piezoelectric actuator 4 is fixed within a receiving portion of a stationary piezoelectric actuator cover 12, and the lower end is attached to a top surface of actuator adapter 13. An actuator cover retainer 16 retains actuator cover 12 via a secured connection to one end of actuator housing 19. In one embodiment, the actuator cover retainer 16 is secured to an end of the actuator housing 19 via a threaded connection. Any other suitable connection type may be employed to retain actuator cover retainer 16 to the end of actuator housing 19.

Actuator housing 19 also includes a fuel drain cavity 23 within inner cavity 47. In the disclosed embodiment, actuator link 14 is positioned within fuel drain cavity 23. A bottom surface of actuator adapter 13 abuts against one end of actuator link 14 in fuel drain cavity 23. The other end of actuator link 14 is supported via abutting engagement with an end of actuator plunger 15 within fuel drain cavity 23. Actuator adapter 13 is used to transmit the actuating load and to keep the load centered and distributed evenly across the piezoelectric actuator 4 element. Actuator link 14 includes a spherical surface on each end to keep the forces centered while allowing misalignment due to manufacturing and assembly tolerances.

Actuator pre-load spring 17 is seated, at one end, against actuator link 14 within the fuel drain cavity 23. For example, the embodiment shown in FIGS. 1A and 1B depicts outer end of actuator pre-load spring 17 biased against a flanged surface area of actuator link 14 and the inner end biased against an inner surface of actuator housing 19 forming fuel drain cavity 23. As shown, this biasing force biases link 14 outwardly and resists the downward movement of actuator link 14.

The actuator housing 19 also includes a bore 49 for receiving actuator plunger 15 having a prescribed diameter A. The diameter A of actuator plunger 15 is sized and configured to provide a close, or match, fit relation to bore 49 in order to minimize any fuel leakage into the fuel drain cavity 23 while permitting sliding movement of plunger 15. Fuel leakage at diameter A is further reduced by the use a leakage control feature 20 including an annular channel 64 formed in the end surface 65 of actuator housing 19 and extending around actuator plunger 15 and bore 49 to receive pressurized fuel. Channel 64 is filled with fuel from a fuel supply cavity 18 of injector barrel 22 in order to counteract radial pressure forces continuously.

Injector barrel 22 houses hydraulic link assembly 5 within fuel supply cavity 18. In one embodiment, injector barrel 22 includes a receiving portion 51 for accommodating and retaining an end of actuator housing 19 such as via a secured connection, e.g., a threaded connection, at one end of injector barrel 22. Any other suitable connection type may be employed to retain the end of the actuator housing 19 within the end of injector barrel 22.

The hydraulic link assembly 5 includes a hydraulic link barrel 6, a hydraulic link outer plunger 7, a hydraulic link inner plunger 8, and a hydraulic link return spring 10. Hydraulic link inner plunger 8 is positioned for relative axial slidable movement within hydraulic link outer plunger 7 which is positioned for relative axial slidable movement within hydraulic link barrel 6. Hydraulic link assembly 5 functions to convert the downward motion of piezoelectric actuator 4 to an upward motion of needle valve 3, as well as to amplify the motion of piezoelectric actuator 4 to lift needle valve 3 by an appropriate amount. Given an available actuator 4 stroke, the magnitude of the needle valve 3 lift can be varied by changing the hydraulic link assembly 5 area ratio formed by the plunger diameters B, C, and D. Given an available actuator 4 force, the maximum fuel supply pressure that the needle valve 3 can open against is determined by diameter F (needle valve seat 24 diameter) and the hydraulic link assembly 5 area ratio formed by the plunger diameters B, C, and D. The injector of the present invention is direct acting in that it directly uses the force of the piezoelectric actuator 4 to apply a moving force to needle valve 3 and does not require an intermediate pressure or force loss, such as depressurizing a pressurized control volume by creating a low pressure drain flow from a control volume. The hydraulic link barrel 6, hydraulic link outer plunger 7, and hydraulic link inner plunger 8 are assembled in a telescoping, interfitting and overlapping relationship within fuel supply cavity 18 of the injector barrel 22. A fuel inlet 61 is configured to supply fuel to fuel supply cavity 18. A delivery passage 85 formed in hydraulic link barrel 6 permits flow throughout cavity 18. The fuel supply pressure may be within a pressure range of approximately 350-2700 bar.

Hydraulic link outer plunger 7 includes a center bore 56 for receiving an end of hydraulic link inner plunger 8. An upper surface of the hydraulic link outer plunger 7 is in abutment with an inner end of the actuator plunger 15 disposed within the fuel supply cavity 18. An end of hydraulic link outer plunger 7 is positioned for slidable movement within an inner bore 53 of hydraulic link barrel 6. The inner end of hydraulic return spring 10 rests atop one end of hydraulic link barrel 6. In the disclosed embodiment, the outer end of spring 10 abuts a flanged surface of hydraulic link outer plunger 7 to bias the flanged surface away from the end of hydraulic link barrel 6. Hydraulic link barrel 6 also includes a bore 54 for receiving a portion of hydraulic link inner plunger 8 therethrough.

In a final assembly and/or prior to a pre-injection event, a portion of hydraulic link inner plunger 8 is positioned in bore 54 of hydraulic link barrel 6 such that one end of hydraulic link inner plunger 8 is disposed within center bore 56 of hydraulic link outer plunger 7. An end 57 of hydraulic link inner plunger 8 is disposed a distance away from an end or stop surface 55 of hydraulic link outer plunger 8. The end or stop surface 55, the end 57 of hydraulic link inner plunger 8, and the sides of a center bore 56 define a fuel supply chamber 50. Fuel supply chamber 50 receives fuel from fuel supply cavity 18 such as via orifice 62 formed in hydraulic link outer plunger 7. The fuel within the fuel supply chamber 50 is at supply pressure before a pre-injection event. The outer diameter D of hydraulic link inner plunger 8 is configured to provide a close or match fit relation to an inner diameter/surface of bore 54 in order to minimize any fuel leakage between the outer diameter of hydraulic link inner plunger 8 and the inner diameter of bore 54 while permitting relative sliding movement.

In addition, a portion of an end of hydraulic link outer plunger 7 is disposed within inner bore 53 of hydraulic link barrel 6 such that an end of hydraulic link inner plunger 8 and a portion of hydraulic link outer plunger 7 are all disposed within inner bore 53 of hydraulic link barrel 6. An end 59 of hydraulic link outer plunger 7 is disposed a distance away from an end or stop surface 58 of inner bore 53. The end or stop surface 58, the end 59, the outer surface of hydraulic link inner plunger 8, and an inner surface of inner bore 53 define a hydraulic link chamber 11, disposed within inner bore 53 of hydraulic link barrel 6, for receiving fuel. The fuel may be disposed within hydraulic link chamber 11 via specialized assembly processes or supplied via fuel from fuel supply cavity 18 as further described below. The fuel in hydraulic link chamber 11 forms a hydraulic link for transmitting an actuation force from piezoelectric actuator 4 and hydraulic link outer plunger 7 to hydraulic link inner plunger 8 and thus needle valve 3. The hydraulic link is formed around hydraulic link inner plunger 8 and between one end of hydraulic link outer plunger 7 and hydraulic link barrel 6. The end or stop surface 58 may further include a leakage control feature 29. This feature provides an annular channel 63 in the end or stop surface 58 of hydraulic link barrel 6 and extending around hydraulic link inner plunger 8 in order to allow fuel within hydraulic link chamber 11 to fill channel 63 to counteract radial pressure forces during an injection event as described below.

The outer diameter C of hydraulic link inner plunger 8 is configured to provide a close or match fit relation to center bore 56 in order to minimize any fuel leakage between the outer diameter of the hydraulic link inner plunger 8 and the surface of hydraulic link barrel 6 forming center bore 56. The outer diameter B of hydraulic link outer plunger 7 is configured to provide a close or match fit relation to an inner diameter of inner bore 53 in order to minimize any fuel leakage between these surfaces.

Hydraulic link inner plunger 8 is rigidly attached to needle valve 3 by an appropriate means (e.g. threaded coupling 9, integrally formed, or other means). A needle valve guide 66, having a diameter E, is provided to accurately locate the needle valve 3 within nozzle 2. Fuel flow passages 67 are preferably formed in the outer surface of needle valve 3 to provide a flow path for the fuel to freely flow past the needle valve guide 66. Passages 67 may include any number of grooves or any number of drilled holes in the needle 3 or the nozzle 2.

Nozzle retainer 68 secures nozzle 2 in position with respect to the injector barrel 22. In one embodiment, the nozzle retainer 68 includes a retaining surface 69 for abutting a contact surface 70 of nozzle 2. The exemplary embodiment of FIG. 1A depicts the retaining surface 69 as a flanged portion of the nozzle retainer 68. The nozzle retainer 68 is further coupled to the fuel injector barrel 22 by an appropriate connection means including, for example, threaded coupling means 71. As the threaded coupling means 71 is tightened, retaining surface 69 of nozzle retainer 68 abuts the contact surface 70 to draw nozzle 2 into abutment against injector barrel 22.

The beginning of an injection event is initiated by applying a voltage to piezoelectric actuator 4 at a desired rate which causes it to expand in length. As previously described, the upper end of piezoelectric actuator 4 is fixed to stationary piezoelectric actuator cover 12, and the lower end is attached to actuator adapter 13. The energizing of the piezoelectric actuator 4 thus causes a downward movement of the actuator adapter 13. This downward movement is transmitted to hydraulic link outer plunger 7 via actuator adapter 13, actuator link 14, actuator plunger 15, and a hydraulic link adapter 43. The downward movement of hydraulic link outer plunger 7 displaces a trapped volume of fuel, i.e. the hydraulic link, in hydraulic link chamber 11. Due to the substantial incompressibility of the fuel, the displaced fuel causes hydraulic link inner plunger 8 to move in an upward direction. Since hydraulic link inner plunger 8 is rigidly attached to needle valve 3, such as via threaded coupling 9, needle valve 3 is lifted off needle valve seat 24 allowing fuel to be injected into the engine combustion chamber via the sac chamber 25 and spray holes or orifices 26. The magnitude of the needle valve lift can be varied by changing the hydraulic link assembly 5 area ratio formed by the plunger diameters B, C, and D.

The opening force required to lift needle valve 3 off its valve seat is a function of the fuel supply pressure, the sac pressure, and diameter F (needle valve seat 24 diameter). The upward pressure induced force, that initiates the upward movement hydraulic link inner plunger 8, is generated in hydraulic link chamber 11 and acts on an annular land 81 formed on hydraulic link inner plunger 8. After needle valve 3 has moved off its seat into an open position, a lower force is required to hold needle valve 3 and hydraulic link inner plunger 8 in an upper/open position due to the increased sac pressure which creates a larger upward force acting on diameter F of needle valve 3. The force required from piezoelectric actuator 4 is a function of the needle valve opening force or holding force and the hydraulic link assembly 5 area ratio (i.e. pressure areas created by diameters B, C, and D). The present invention determines that this force requirement matches well with the piezoelectric actuator characteristics as the maximum actuator force is available at the beginning of needle valve lift. The ending of injection is initiated by reducing the voltage to piezoelectric actuator 4 at a desired rate to cause needle valve 3 to return to a closed position thus ending the fuel flow to the combustion chamber.

Piezoelectric element 4 comprises a columnar laminated body of thin disk-shaped elements, each having a piezoelectric effect so that when a voltage is applied to the piezoelectric elements, the elements become charged and expand along the axial direction of the column. Of course, the stack of piezoelectric elements may be of any type or design that is suitable for actuator link 14 and plunger 15. An increase in the voltage applied to piezoelectric actuator 4 causes axial expansion of the stack of piezoelectric elements in a first direction, i.e., towards needle valve 4, causing downward movement of hydraulic link outer plunger 7. A decrease in the voltage applied to piezoelectric actuator 7 causes axial contraction of the stack of piezoelectric elements in a second direction, i.e., away from needle valve 4, causing upward movement of hydraulic link outer plunger 7.

The location of hydraulic link assembly 5 within fuel supply cavity 18 results in a fast closing of needle valve 3 closing, due to the fuel supply pressure acting downwardly on the full area of the needle valve seat diameter F which results in a relatively large downward hydraulic force. When the ending of injection is initiated, the piezoelectric actuator 4 force has returned to a small value allowing all pressures acting on all surfaces of the outer plunger 8 and the needle valve 3 above diameter F to be equal to the fuel supply pressure. The lower part of the needle valve 3 below diameter F is acted on by the sac pressure which is lower than the fuel supply pressure due to the restriction through the needle valve seat 24. Thus the pressure difference between the fuel supply pressure and the sac pressure, acting on diameter F, results in a significant hydraulic force acting in a direction to move the needle valve toward the closed position. As the needle valve 3 moves from the open position to the closed position, the pressure difference between the fuel supply pressure and the sac pressure increases which in turn results in the hydraulic force increasing proportionally. This in turn causes the needle valve 3 to move faster toward the closed position. Needle bias spring 28 also applies a closing force to needle valve 3. This combined force also holds the needle closed during engine starting as the combustion chamber pressure increases. The closing velocity of needle valve 3 is preferably limited to avoid damaging the needle valve seat 24. Accordingly, the present invention controls the needle valve 3 closing velocity by reducing the voltage to piezoelectric actuator 4 at an appropriate rate.

When the downward movement of hydraulic link outer plunger 7 displaces the trapped volume of fuel in hydraulic link chamber 11, the aforementioned trapped volume of fuel may be pressurized significantly higher than the supply pressure of the fuel. For example, the trapped volume of fuel within hydraulic link chamber 11 may be pressurized as much as 500 bar above the fuel supply pressure disposed, for instance, in fuel supply cavity 18. When hydraulic link chamber 11 pressure rises above the fuel supply pressure (e.g. during injection), a small volume of fuel may leak out of hydraulic link chamber 11 such as via the plunger interfaces at diameters B, C, and D. In order for the aforementioned leaked volume of fuel to be refilled between injection events, hydraulic link chamber 11 pressure must be lower than the surrounding fuel supply pressure. This is accomplished with the use of hydraulic link return spring 10. Hydraulic link return spring 10 provides an upward force against hydraulic link outer plunger 7, thereby, causing the hydraulic link chamber 11 pressure to be lower than the surrounding fuel supply pressure. This upward force also ensures that hydraulic link outer plunger 7 will always follow the movement of piezoelectric actuator 4 as it is energized and de-energized. The volume of fuel leaked out of hydraulic link chamber 11 is refilled at the same locations, that is, plunger interfaces at diameters B, C, and D). Some operating conditions may require additional flow of fuel to refill hydraulic link chamber 11 at a faster pace. In such cases, an additional refill valve may be employed to reduce the refill fuel time as further described below in the additional embodiments.

By minimizing fuel leakage, components of fuel injector 1 are more readily positioned to provide another injection event at a quicker response time. Thus, it is advantageous to minimize hydraulic link chamber 11 leakage during injection events. Accordingly, the present invention employs several features for this purpose. One feature includes using very small clearances at the three plunger interfaces, i.e., diameters B, C, and D, to limit fuel leakage. Additional embodiments of the present invention for further reducing fuel leakage out of the hydraulic link chamber 11 include exposing an outer surface 73 of hydraulic link barrel 6 to the fuel supply pressure which results in an inward radial hydraulic force on hydraulic link barrel 6. An annular gap 52 is formed between the outer surface 73 and the opposing surface of injector body 27 forming fuel supply cavity 18. This radial hydraulic force tends to minimize the expansion of diameter B when the pressure in hydraulic link chamber 11 is higher than the fuel supply pressure. In contrast, if hydraulic link barrel 6 were an integral part of fuel injector barrel 22, a higher fuel leakage rate would result due to a relatively low pressure on the outside of the fuel injector barrel 22 which would further allow a greater expansion of diameter B. This expansion, in turn, would allow more fuel leakage out of hydraulic link control chamber 11.

To further reduce the leakage out of hydraulic link chamber 11, the inside of hydraulic link barrel 6 may be configured to include leakage control feature 29. The leakage control feature 29 works to prevent excessive clearance and enlargement of bore 54 such as at diameter D. The disclosed embodiment of the leakage control feature 29 includes a channel 63 for receiving fuel therein. Thus, when the fuel within hydraulic link control chamber 11 becomes pressurized, the pressurized fuel will be received within channel 63 to create pressure-induced forces acting along sides of channel 63 to urge an annular portion 72 of hydraulic link barrel 6 adjacent to the bore 54 towards inner plunger 8. Consequently, the pressure forces act on annular portion 72 to create an inward radial force to minimize fuel leakage from and along the annular clearance gap at diameter D. Without the leakage control feature 29, the outer surface 73 of hydraulic link barrel 6 is exposed at a lower fuel supply pressure and would, thus, allow additional clearance and enlargement of bore 54 at diameter D to produce increased fuel leakage through the clearance gap between portion 72 and inner plunger 8.

The positioning of the disclosed components of fuel injector 1 also reduces the fuel leakage out of hydraulic link control chamber 11. More specifically, the configuration and/or use of hydraulic link outer plunger 7 with respect to hydraulic link inner plunger 8 results in the same hydraulic link chamber 11 pressure acting on the surfaces of hydraulic link outer plunger 7 at diameters B and C. This minimizes the amount of enlargement of the clearance in diameter C to prevent or reduce fuel leakage.

Hydraulic link assembly 5 also compensates for variations in the lift of needle valve 3 that would result from temperature changes of the fuel injector 1. The coefficient of thermal expansion of the stack element of piezoelectric actuator 4 is significantly different than the other related fuel injector components. Thermal changes cause the axial relative position of actuator adapter 13 to change with respect to the actuator housing 19. These changes in turn would cause a variation of the lift of needle valve 3 with respect to the movement of piezoelectric actuator 4 if hydraulic link assembly 5 of the present invention were not used. Hence, any needle valve lift variation is avoided as a result of the present invention providing refilling of hydraulic link chamber 11 each time between injection events when piezoelectric actuator 4 is de-energized, and needle valve 3 is seated. The hydraulic link volume varies, as required, to compensate for the effect of any thermal changes while maintaining the necessary pressure regulation required in various chambers/cavities/passageways of the fuel injector 1 (e.g., hydraulic link chamber 11, fuel supply cavity 18, and fuel supply chamber 50).

Hydraulic link assembly 5 also utilizes a unique packaging system and method whereby hydraulic link assembly 5 components are arranged concentrically to create a single hydraulic link chamber 11 with no separate fuel passage. Some other designs use two separate chambers connected by a small fuel passage (e.g. U.S. Pat. No. 6,520,423). This creates a hydraulic link assembly 5 which operates more responsively to the energizing and de-energizing of the piezoelectric actuator 4. Hence, the fuel injector 1 of the present invention is capable of producing more pulses per engine firing and under higher sac pressures. By doing so, the resulting spray plume may be more efficiently delivered to the combustion chamber. In addition, the improved dispersion of the spray plume under high pressures, obtained by the present invention, may facilitate better combustion and improved burning of the spray which can result in better fuel economy.

If piezoelectric actuator 4 is capable of moving within actuator housing 19 in a loose fashion, it is possible that actuator 4 may become damaged during operation. Also the piezoelectric actuator 4 material can be damaged internally (e.g. cracks or breaks) if it does not have a compressive load applied at the time of the very fast voltage changes during energizing and de-energizing. This damage is due to the piezoelectric actuator 4 material tensile strength being lower than the instantaneous internal inertia forces. The material can be pulled apart or cracked. In order to better secure actuator 4, a preload force is utilized to prevent damage to actuator 4. This force is supplied by the combination of the force from actuator preload spring 17, the force from hydraulic link return spring 10, and the force resulting from the fuel supply pressure acting on the bottom of actuator plunger 15. The actuator preload spring 17 is not required if the combined force from hydraulic link return spring 10 and the hydraulic force mentioned above is sufficient to prevent actuator 4 damage. Due to the unique operating characteristics of piezoelectric actuator 4, the preload force does not inhibit or reduce the amount of force available from piezoelectric actuator 4.

According to disclosed embodiments of the invention, diameter A of actuator plunger 15 is relatively small to minimize the fuel leakage from fuel supply cavity 18 (generally under high pressure) to the fuel drain pressure cavity 23 (generally under low pressure) via diameter A. A very small clearance between actuator plunger 15 and bore 49 at diameter A is also used to further reduce any fuel leakage. The fuel leakage at diameter A is further reduced by the leakage control feature 20 created in the actuator housing 19. The leakage control feature 20 works to prevent excessive clearance and enlargement of the bore 49 such as at diameter A. The disclosed embodiment of the leakage control feature 20 includes a channel 74 which receives an amount of fuel therein such as from fuel supply cavity 18. Thus, when piezoelectric actuator 4 is energized to pressurize fuel within hydraulic link control chamber 11, pressurized fuel, from fuel supply cavity 18 will be received within channel 74 and act along sides of channel 74 to urge a material portion 75, adjacent to the bore 49 at diameter A, inwardly. Consequently, the pressurized force acts on material portion 75 to create an inward radial force to minimize fuel leakage from and along diameter A of bore 49. Without leakage control feature 20 to provide a tighter fit at diameter A, bore 49 would be more susceptible to enlarging, for example, due to the outer surface of actuator housing 19 being exposed to a lower drain pressure thereby allowing excessive clearance for fuel leakage.

Excessive high pressure leakage is often a limitation for achieving high injection pressures in fuel injection systems. A designed improvement of the present invention includes the leakage at actuator plunger 15 diameter A being the only source of high pressure leakage provided to fuel drain cavity 23. Due to this design, the aforementioned high pressure leakage is relatively low. Thus, fuel injector 1 of the current invention is capable of providing higher injection pressures for use during injection events as well as minimizing fuel flow requirements to the injector. These enhanced features provide quicker response times during fuel injection events as well as more pulsations of fuel per engine firing cycle.

The use of actuator plunger 15 allows piezoelectric actuator 4 to be located in fuel drain cavity 23, which is generally under low pressure. This design allows the sealing arrangement for the electrical wire of the piezoelectric actuated fuel injector 1 to easily satisfy sealing requirements of low pressures regions. By doing so, the improved design eliminates more difficult and costly sealing of electrical wiring, as in some prior art injectors, which typically locate the piezoelectric actuator in a high pressure cavity. Moreover, fuel injector 1 of the present invention allows the use of a very low pressure in fuel drain cavity 23 due to the location of hydraulic link assembly 5 in fuel supply cavity 18. Accordingly, improved fuel injector 1 provides a configuration which locates a source for refilling hydraulic link chamber 11 such that chamber 11 is subjected to the supply pressure (i.e., at very high pressure) and not the drain pressure (typically at very low pressure). Conversely, some prior art injectors require a higher drain pressure simply to perform an injection event. This may not only require additional components and assembly processes at additional costs, but also results in a relatively low pressure fuel injection event in comparison to the improved high pressure fuel injection provided by the present invention.

To prevent hydraulic link plunger binding, such as due to normal manufacturing and assembly tolerances, a leveling washer 21 is provided and used to support hydraulic link assembly 5. In one embodiment, leveling washer 21 is located on a tapered, spherical, or similar inner surface of injector barrel 22. Leveling washer 21 has a spherical surface on the side mating with injector barrel 22 and a flat surface interface with hydraulic link 5 thus allowing it to tilt as required to maintain full surface contact with hydraulic link assembly 5. Hydraulic link assembly 5 can also freely move sideways with respect to leveling washer 21.

To further prevent hydraulic link plunger binding, such as due to normal manufacturing and assembly tolerances, the present invention provides a hydraulic link adapter 43 having a spherical surface interface with hydraulic link outer plunger 7 and a flat surface interface with actuator plunger 15. Hydraulic link adapter 43 tilts as necessary or is required to maintain full surface contact with the face of the actuator plunger 15. Hydraulic link assembly 5 can also freely move sideways with respect to actuator plunger 15 as necessary.

In many prior art applications, traditional fuel injector bodies include high stress regions adjacent to fuel passages, which are often a limitation for achieving high injection pressures. These prior art fuel injectors may often utilize fuel passages formed by thinner walls (e.g. long drillings, intersecting drillings, thin walls, etc.) which simply cannot support higher pressure ranges. The present invention provides a fuel injector design which results in no fuel passages under high stress due to the fuel supply pressure. Consequently, this allows an improved fuel injector 1 capable of producing higher injection pressures during use.

The design of fuel injector 1 also avoids the need for any orifices or restrictions in the fuel supply passages upstream from needle seat 24 thus maximizing sac pressure and minimizing the flow and pressure requirements to fuel injector 1. It should be noted that some prior art injectors utilize one or more restricting orifices upstream from the needle seat thus reducing the available sac pressure.

Figure 2:
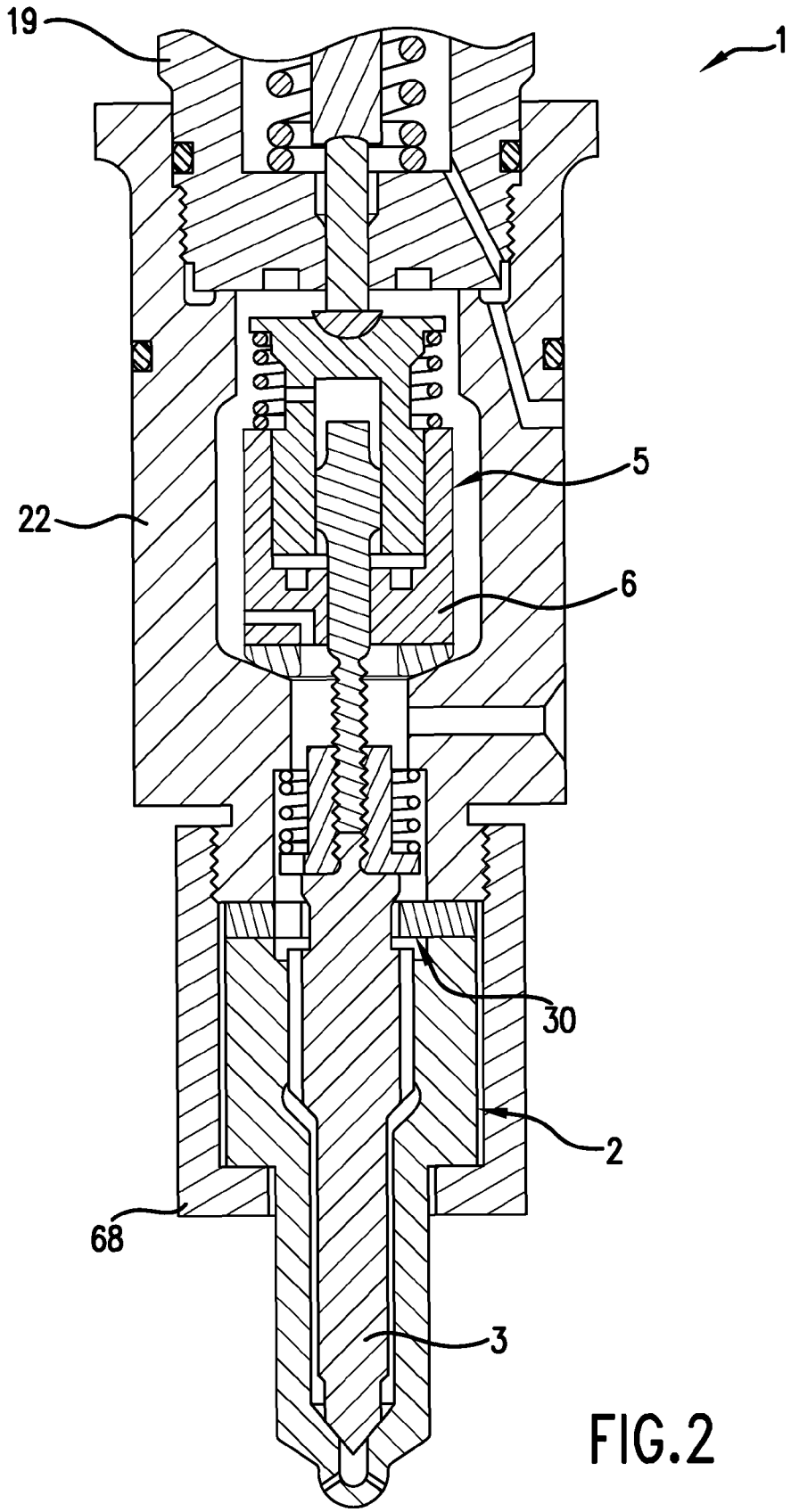
FIG. 2 provides a schematic illustration of another embodiment of a piezoelectric actuated fuel injector including a needle valve stop according to an exemplary disclosed embodiment.

Turning to FIG. 2, another embodiment of the piezoelectric actuated fuel injector 1 is illustrated according to an exemplary disclosed embodiment. Generally, when raised quickly to a desired lifted position, needle valve 3 shown in FIGS. 1A and 1B can oscillate in the lifted position for a given time. It may be desirable to limit the lift movement of needle valve 3 in order to allow needle valve 3 to recover in position for another fuel injection event. FIG. 2 shows another embodiment of fuel injector 1 (shown in FIGS. 1A and 1B) with the addition of a needle valve stop 30 to limit the maximum lift motion of needle valve 3. The employment of needle valve stop 30 serves to provide a predetermined accurate, stable limit of travel for needle valve 3 to achieve a more consistent fuel delivery. Needle valve stop 30 is located longitudinally along the injector between orifices 26 and hydraulic link assembly 5. Skilled artisans may appreciate that needle valve 3 may not be required to reach needle valve stop 30 in all operation conditions (e.g. multi-pulse operation with very small separation time).

Figure 3:
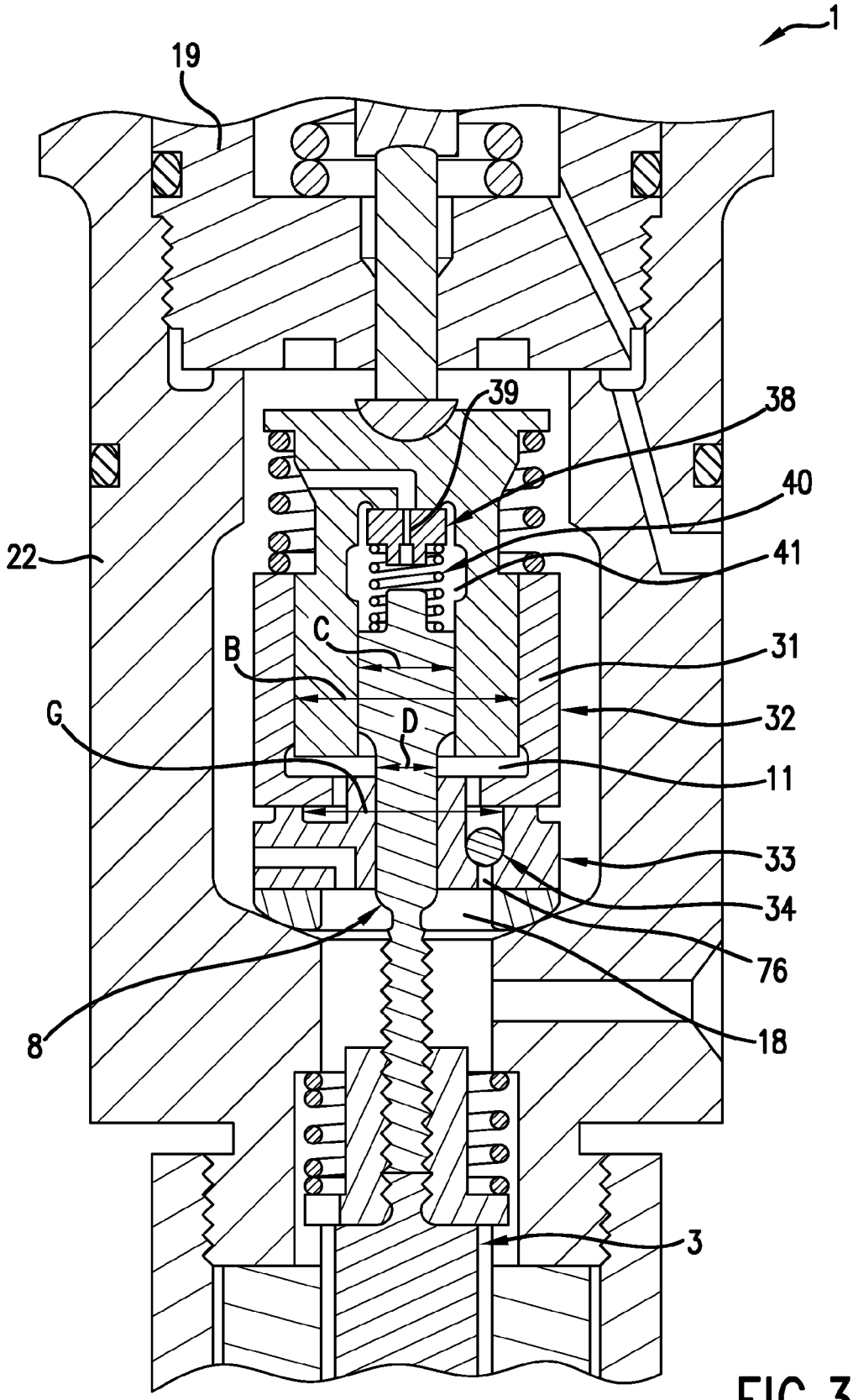
FIG. 3 provides a schematic illustration of another embodiment of a piezoelectric actuated fuel injector including a snubber valve, two-piece hydraulic link barrel, and hydraulic link refill valve according to an exemplary disclosed embodiment.

As just previously mentioned, needle valve 3 (e.g., FIGS. 1A and 1B) may be raised quickly to a desired lift position and have a tendency to oscillate around that position for a given period of time. FIG. 3 shows another embodiment of fuel injector 1 (shown in FIGS. 1A and 1B) with the addition of a snubber valve 38 positioned in the hydraulic link outer plunger 7, including a snubber valve orifice 39, and a snubber valve spring 40 for biasing snubber valve 38 into abutment against hydraulic outer plunger 7. Snubber valve 38 is employed for the purpose of quickly damping the oscillations of needle valve 3 to achieve a more consistent fuel delivery. This is accomplished as the fuel trapped in snubber valve chamber 41 exits via the snubber valve orifice 39, providing a restriction to the outward fuel flow and thus restricting the movement of needle valve 3 in the raising direction. Snubber valve 38 also allows fuel to enter snubber valve chamber 41 by moving snubber valve 38 away from hydraulic link outer plunger 7 against the small bias force of spring 40 causing little restriction to the movement of needle valve 3 in the lowering direction. Snubber valve spring 40 may also facilitate repositioning of needle valve 3 through contact with hydraulic link inner plunger 8. However, valve spring 40 may be omitted in some operating conditions.

Hydraulic link assembly 5 shown in FIGS. 1A and 1B has a one-piece hydraulic link barrel 6. In order to avoid plunger binding, such as due to manufacturing and assembly tolerances, the configuration shown in FIGS. 1A and 1B requires extremely close control of the plunger diameter concentricity tolerances and/or larger plunger clearances, for example, at diameters B, C, and/or D, which invariably controls the amount of fuel leakage and/or cost. FIG. 3 shows another embodiment of the fuel injector 1 (shown in FIGS. 1A and 1B) where a hydraulic link assembly 31 uses an additional hydraulic link base 33 which is separate from the hydraulic link barrel 32. This embodiment provides a two-piece hydraulic link barrel configuration which further decreases the likelihood of plunger binding. The disclosed two-piece hydraulic link barrel configuration provides the use of a flat surface interface between mating faces of hydraulic link barrel 32 and hydraulic link base 33. This configuration allows hydraulic link barrel 32 to slide sideways as required with respect to hydraulic link base 33. This embodiment also allows increased plunger diameter concentricity tolerances to minimize cost. Additionally, very small plunger clearances, at diameters B, C, and D, may be employed to minimize leakages from hydraulic link chamber 11. The seal joint loading between the mating faces of hydraulic link barrel 32 and hydraulic link base 33 is provided as the effective seal diameter of the joint (diameter G). In a preferred design, the joint (diameter G) is always made smaller than diameter B to provide a surface for the pressure difference between hydraulic link chamber 11 pressure and fuel supply cavity 18 pressure to act on (i.e. the area between diameters B and G). When hydraulic link chamber 11 pressure is greater than fuel supply cavity 18 pressure, there is a downward hydraulic force pushing the joint together. When hydraulic link chamber 11 pressure is less than the fuel supply cavity 18 pressure, there is an upward hydraulic force pushing the joint together.

In some operating conditions, there may be insufficient time available to refill the hydraulic link chamber 11 between injection events using only the three plunger fits (diameters B, C, and D) of fuel injector 1 (shown in FIGS. 1A and 1B). FIG. 3 shows another embodiment of fuel injector 1 where a hydraulic link refill valve 34 is added to the hydraulic link base 33. Hydraulic link refill valve 34 provides a passage 76 with a relatively large flow area for refilling hydraulic link chamber 11 very quickly between injection events while minimizing leakage flow out of hydraulic link chamber 11 during injection. In one disclosed embodiment, hydraulic link refill valve 34 consists of a ball (or a flat disc or similar configuration) which provides a one-way seal with a suitable seat in the mating part to form an orifice/check valve arrangement. The seat outer diameter surrounds the ball which provides a controlled flow passage area around the ball. The maximum travel of the ball is limited by the depth of the seat with respect to the bottom face of hydraulic link barrel 32. Hydraulic link refill valve 34 can be spring-loaded in either direction if required by specific operating conditions.

In operation, when the pressure in hydraulic link chamber 11 is below the pressure in fuel supply cavity 18, the ball becomes unseated to allow fuel flow through the flow area 76 to refill hydraulic link chamber 11 (e.g., between injection events). When the pressure in hydraulic link chamber 11 becomes greater than the pressure in fuel supply cavity 18, pressurized fuel from hydraulic link chamber 11 urges the ball towards the ball seat until it becomes seated to close off passage 76 (e.g., when injection begins). The passage 76 remains closed as long as hydraulic link chamber 11 pressure is greater than the supply pressure.

Figure 4:
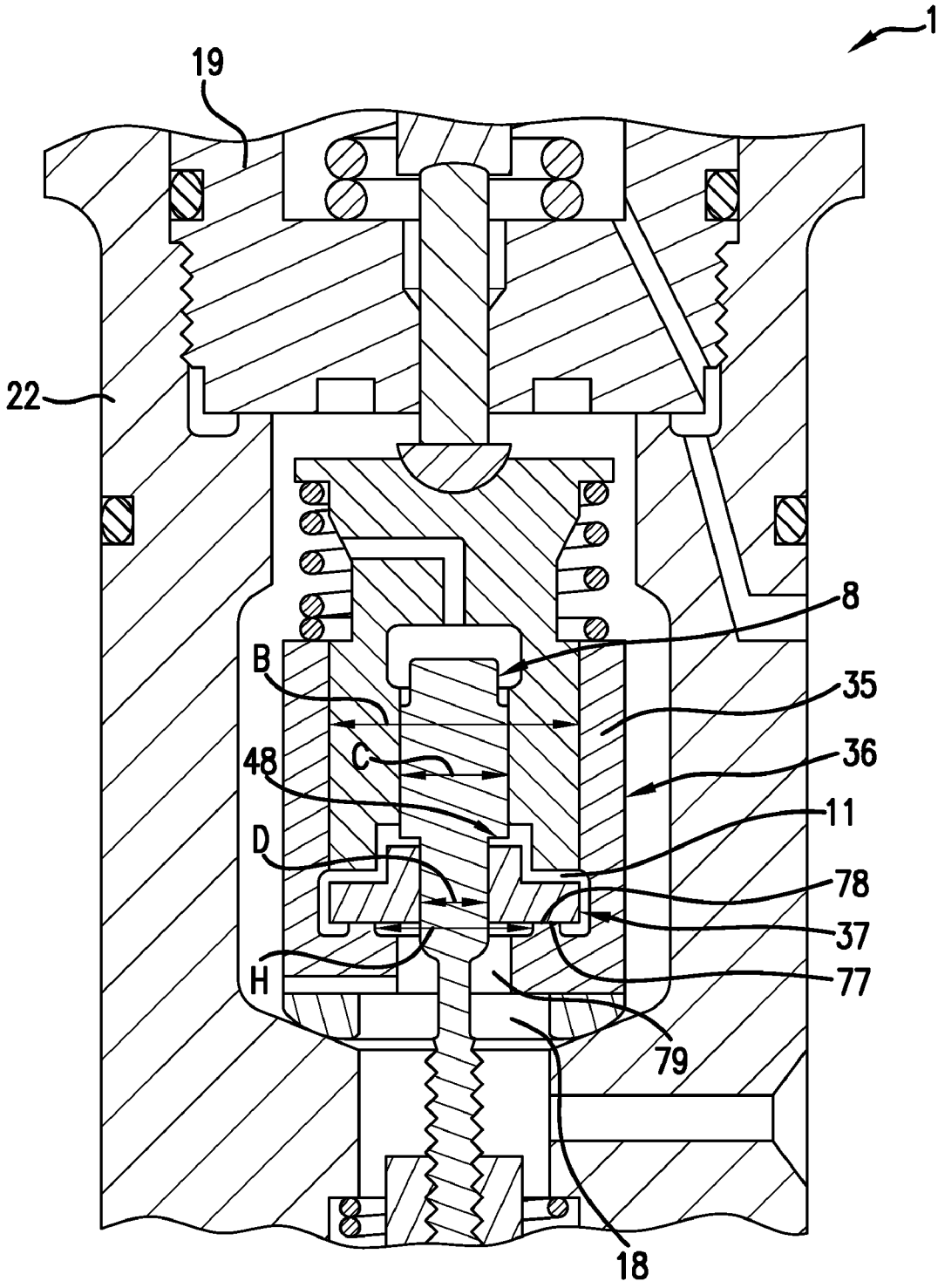
FIG. 4 provides a schematic illustration of another embodiment of a piezoelectric actuated fuel injector including another embodiment of a hydraulic link refill valve according to an exemplary disclosed embodiment.

FIG. 4 illustrates another exemplary embodiment of fuel injector 1 (shown in FIGS. 1A and 1B), in which there may be insufficient time available to refill hydraulic link chamber 11 between injection events using only the three plunger fits (diameters B, C, and D). Hydraulic link assembly 35 utilizes a hydraulic link refill valve 37 located inside the hydraulic link barrel 36. Hydraulic link barrel 36 includes a sealing surface 77 positioned for abutment by a contact surface 78 of hydraulic link refill valve 37 to prevent fuel flow from fuel supply cavity 18 into hydraulic link chamber 11. The maximum opening of hydraulic link refill valve 37 can be limited by a refill valve stop 48 which, in an exemplary embodiment, is a face formed on hydraulic link inner plunger 8.

In operation, hydraulic link refill valve 37 may open to provide a relatively large flow area when hydraulic link chamber 11 pressure is less than fuel supply cavity 18 pressure. Accordingly, pressure is equalized between fuel supply cavity 18 and hydraulic link chamber 11 by fuel flowing into a fuel flow passage 79 towards hydraulic link chamber 11. Doing so urges the contact surface 78 to become unseated from sealing surface 77 as hydraulic link refill valve 37 is urged towards refill valve stop 48. Opening of hydraulic link refill valve 37 allows refilling of hydraulic link chamber 11 to occur quickly (e.g. between injection events). Hydraulic link refill valve 37 closes when fuel pressure in hydraulic link chamber 11 is greater than the fuel pressure in fuel supply cavity 18 (e.g. when injection begins).

This configuration also prevents plunger binding (e.g., due to normal manufacturing and assembly tolerances) by using a flat surface interface between the mating faces 77, 78 of hydraulic link barrel 36 and hydraulic link refill valve 37, respectively, allowing the hydraulic link barrel 36 to slide sideways as required with respect to hydraulic link refill valve 37. This embodiment also allows increased hydraulic link diameter concentricity tolerances to minimize cost and allows very small plunger clearances at diameters B, C, and D to minimize leakages from hydraulic link chamber 11.

The seal joint loading between the mating faces of hydraulic link barrel 36 and hydraulic link refill valve 37 is provided as the effective seal diameter of the joint (diameter H) and is always made larger than diameter D to provide a surface for the pressure difference between hydraulic link chamber 11 pressure and fuel supply cavity 18 pressure to act on (i.e. the area between diameters H and D). When hydraulic link chamber 11 pressure is greater than fuel supply cavity 18 pressure, there is downward hydraulic force pushing the joint together. Hydraulic link refill valve 34 may also be spring loaded such as in an X or Y direction if required by specific operating conditions.

Figure 5:
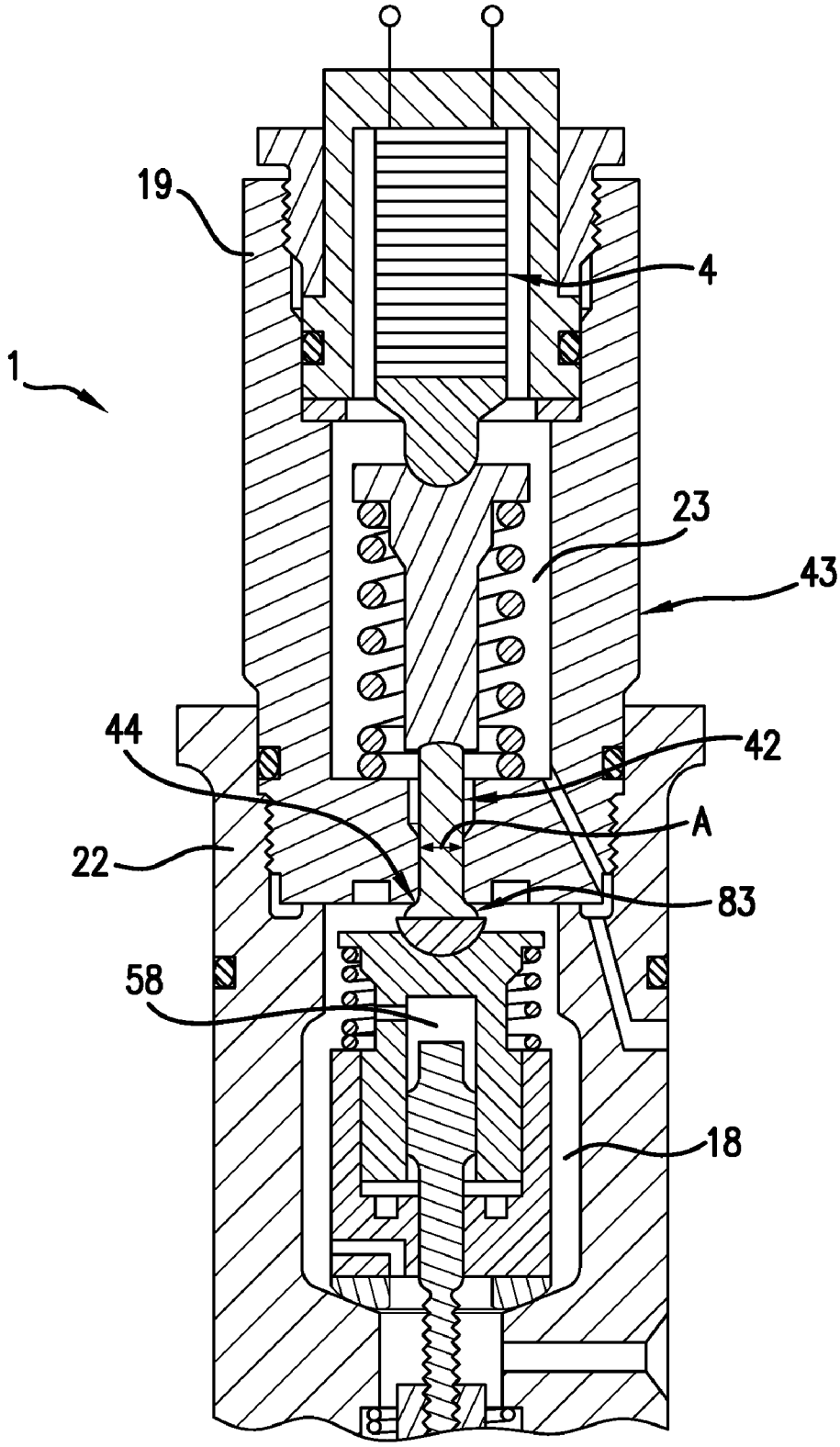
FIG. 5 provides a schematic illustration of another embodiment of a piezoelectric actuated fuel injector including an actuator plunger seat for reducing fuel leakage according to an exemplary disclosed embodiment.

Actuator plunger 15 shown in FIGS. 1A and 1B may allow continuous fuel leakage past the plunger clearance at diameter A from fuel supply cavity 18 to fuel drain cavity 23. FIG. 5 shows another embodiment of fuel injector 1 (shown in FIGS. 1A and 1B) where actuator plunger 42 includes a sealing valve 83 for cooperating with an annular plunger seat 44 extending around bore 49. When the actuator plunger 42 is in a downward position with the stack of piezoelectric elements expanded in the first direction (such as during injection), valve 83 is in an open position spaced from actuator plunger seat 44 resulting in fuel leakage past the plunger clearance at diameter A. When actuator plunger 42 is in the upward position with the stack of piezoelectric elements contacted in the second direction (e.g., between injection events), valve 83 is seated against seat 44 in a closed position resulting in no fuel leakage past the plunger clearance at diameter A. The overall fuel leakage past the plunger clearance at diameter A is greatly reduced as most of the time between engine combustion events is spent with valve 83 closed. Consequently, there is no fuel leakage during this time.

Figure 6:
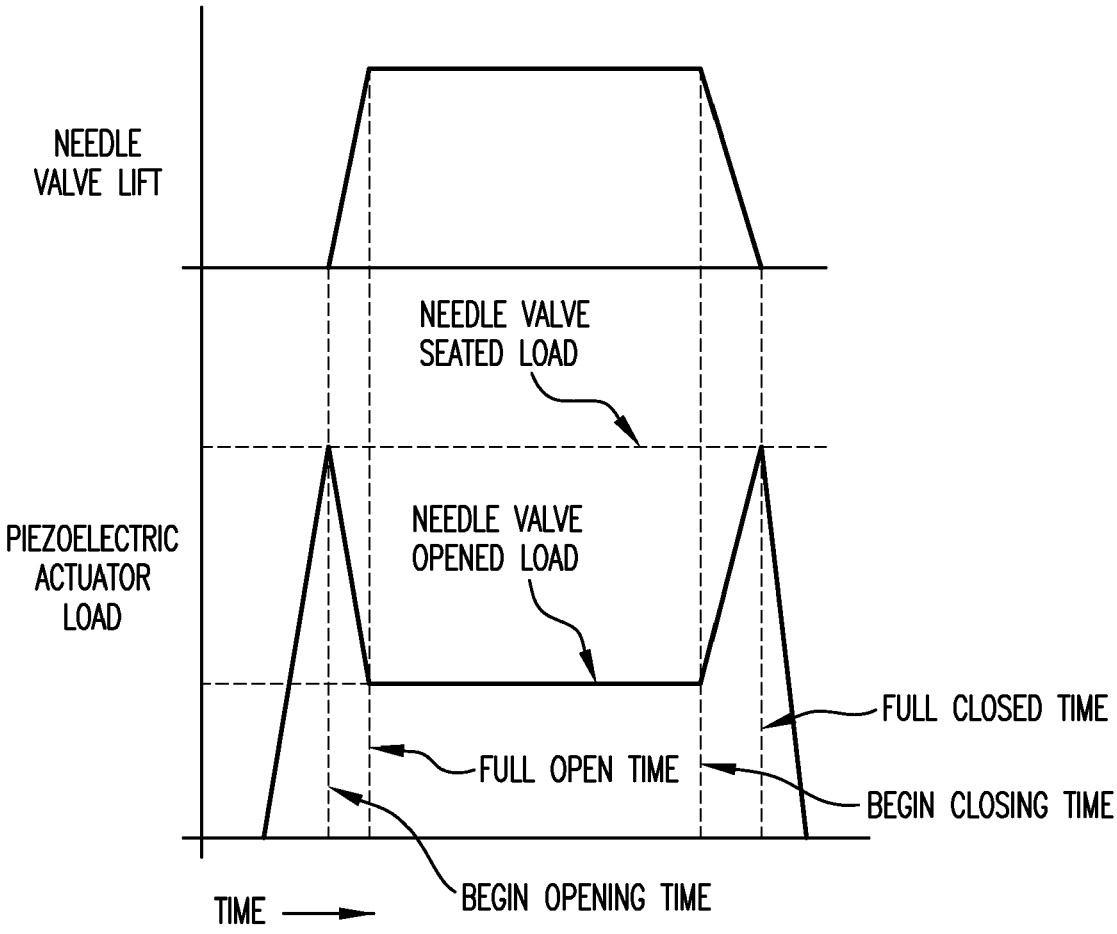
FIG. 6 provides a graphical illustration showing detection of needle valve movement and position by monitoring the piezoelectric actuator load according to an exemplary disclosed embodiment.

Referring also to FIGS. 1A and 1B, FIG. 6 shows a method for detecting the movement and position of needle valve 3 by monitoring piezoelectric actuator 4 load (i.e. force). The following time events for needle valve 3 are indicated as shown in FIG. 6: Begin Opening Time, Full Open Time, Begin Closing Time, and Full Closed Time. The following load values for the piezoelectric actuator are also indicated as shown in FIG. 6: Needle Valve Seated Load and Needle Valve Opened Load. A variation in the Needle Valve Seated Load is an indication of the various injector geometry variations (e.g. diameters A, B, C, D, F, etc.). The Needle Valve Opened Load indicates the force to hold needle valve 3 open, which is also an indication of the pressure drop across needle valve seat 24. Therefore, using the Needle Valve Opened Load in conjunction with the signal from a fuel supply pressure sensor, one is able to determine an indication of fuel delivery to combustion chamber.

The individual fuel injector characteristics (e.g. timing, fueling, etc.) can be captured when the fuel injector is tested. These characteristics may be recorded for each fuel injector, such as by a bar code or other suitable means, to save the measurements for future use. This measured test data can then be an input to an engine electronic control unit or module to adjust for possible variations in timing and fueling, as required, to ensure that all fuel injectors are performing as desired including, for example, having the same performance such that there are no performance changes over time for any or all fuel injectors.

Figure 7:
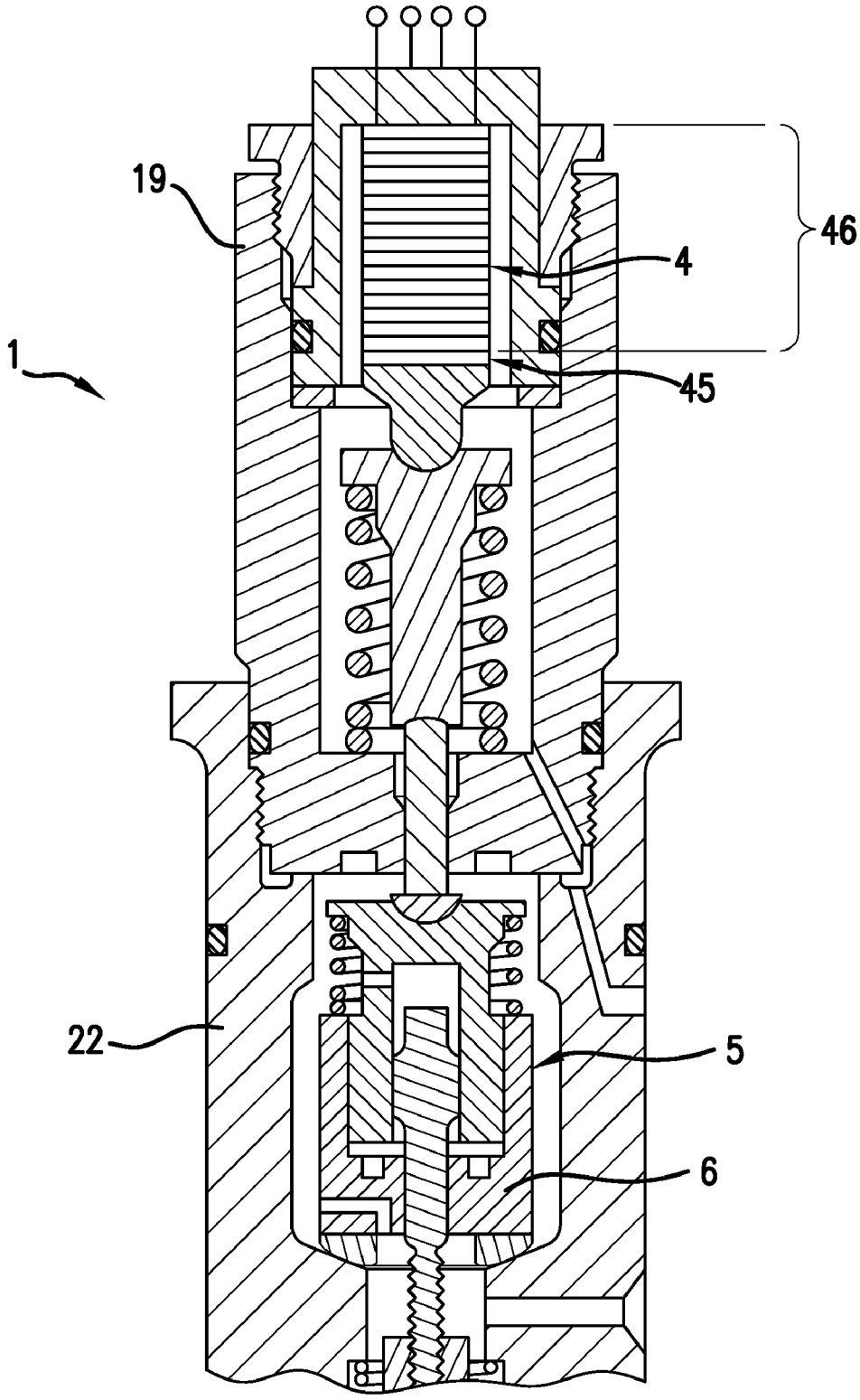
FIG. 7 provides a schematic illustration of another embodiment of a piezoelectric actuated fuel injector including a load cell added in series with a piezoelectric actuator according to an exemplary disclosed embodiment.

One method of monitoring/controlling the piezoelectric actuator load (i.e. force) (as referred to in the above section) is to provide a device to measure force. FIG. 7 shows another embodiment of the injector shown in FIGS. 1A and 1B where a load cell 45 is added in series with piezoelectric actuator element 4. The load cell is a device that indicates load (force) and can be a separate component added to the piezoelectric actuator 4. Alternatively, the load cell can be one or more of the stack elements in the piezoelectric actuator 4 as indicated by the load cell element 45 and the piezoelectric actuator elements 46. Thus, an embodiment of the present invention also provides a means for measuring the piezoelectric actuator 4 load. Additionally, or alternatively, the invention may include a piezoelectric actuator current, voltage, and/or capacitance monitoring device which can be used to derive needle valve events and fueling. Thus the direct acting design of the present injector permits greater control of needle valve movement since actuator characteristics, such as load, current, etc, more directly correspond to needle valve movement and position than injectors that are not direct acting. As a result, closed loop control of injector operation can be effectively utilized.

Hence, the present invention may gain significant advantages over the prior art by seeking to minimize the necessary movement for lifting needle valve 3 off valve seat 24 to perform a fuel injection event within the quickest response time. In some cases, embodiments of the present invention produce many pulses (e.g., 7-9 pulses) per engine firing while maintaining high sac pressures. To achieve such results, the invention provides a unique hydraulic link assembly 5 to connect the piezoelectric actuator 4 with the needle valve 3 utilizing leakage control features, as described herein, to thereby provide a direct acting injector that is more controllable and faster acting while minimizing drain flow. An avoidance of any orifices in the fuel supply passages upstream of needle valve seat 24 is provided in order to maximize sac pressure (i.e., at sac chamber 25). As described above, piezoelectric actuator 4 is deliberately located in a fuel drain cavity 23 (generally under low pressure) and is in communication with a relatively small diameter actuator plunger 15 extending to a high pressure fuel supply cavity 18. Actuator plunger 15 facilitates connection of piezoelectric actuator 4 to hydraulic link assembly 5. Hydraulic link assembly 5 directly acts to convert the downward motion of piezoelectric actuator 4 to an upward motion of needle valve 3 (i.e., hydraulic link outer plunger 7 is pushed down by piezoelectric actuator 4, and needle valve 3 is pushed up by the resulting hydraulic link chamber 11 fuel pressure). Hydraulic link plunger diameters are selected to obtain the optimal motion amplification required for the desired movement of needle valve 3. Hydraulic link chamber 11 is refilled (via an orifice/check valve arrangement) between injection events, as required, to allow the fuel injection components to return to original positions (for subsequent fuel injection events) even when thermal changes occur. A small diameter connection plunger may be utilized having a leakage control feature as described herein.

Furthermore, the ability to refill hydraulic link chamber 11 between injection events facilitates the reduction of wear on components of fuel injector 1. This is also true from the improvement in compensation of thermal effects provided by the disclosed invention. Since both features reduce the movement of the components of fuel injector 1, for example, the individual movement of the parts of hydraulic link assembly 5 within fuel supply cavity 18, the parts are subjected to less wear over the life span of fuel injector 1 and provide greater service life during operation use.

Thus, the injector of the present invention does not require fuel to be spilled to drain to control the injector needle. The only fuel flow to drain is leakage past one plunger, which has a small diameter compared to prior art designs. Also, components that are exposed to high pressure are positioned in a high pressure cavity thereby eliminating leakage from these areas to drain while providing full hydraulic loading on the needle valve for fast closing.

It will be apparent to those skilled in the art that various modifications and variations can be made in the disclosed apparatus and method without departing from the scope of the disclosure. Additionally, other embodiments of the apparatus and method will be apparent to those skilled in the art from consideration of the specification. It is intended that the specification and examples be considered as exemplary only, with a true scope of the disclosure being indicated by the following claims and their equivalents.

What is claimed is:

1. A piezoelectric-actuated fuel injector for injecting fuel into a combustion chamber of an internal combustion engine, comprising:

an injector body containing an injector cavity and an injector orifice communicating with one end of said injector cavity to discharge fuel into the combustion chamber;

a needle valve positioned in one end of said injector cavity adjacent said injector orifice, said needle valve movable between an open position in which fuel flows from the fuel supply circuit through said injector orifice into the combustion chamber and a closed position in which fuel flow through said injector orifice is blocked;

a piezoelectric actuator including a stack of piezoelectric elements movable to expand in a first direction and movable to contract in a second direction opposite said first direction;

a hydraulic link assembly disposed within said injector cavity, said hydraulic link assembly including a hydraulic link barrel having an inner bore, a hydraulic link outer plunger positioned to slidably move in said inner bore and operably connected to said piezoelectric actuator, and a hydraulic link positioned between said hydraulic link barrel and said hydraulic link outer plunger, said hydraulic link operatively connected to said needle valve to move said needle valve in said second direction toward said open position in response to movement of said stack of piezoelectric elements in said first direction.

2. The fuel injector of claim 1, wherein said hydraulic link outer plunger includes a center bore, said hydraulic link assembly further including a hydraulic link inner plunger rigidly attached to the outer end of said needle valve and extending into said center bore of said hydraulic link outer plunger, said hydraulic link outer plunger, said hydraulic link inner plunger and said hydraulic link barrel positioned in overlapping relationship.

3. The fuel injector of claim 2, wherein the hydraulic link is formed around said hydraulic link inner plunger and between one end of said hydraulic link outer plunger and said hydraulic link barrel.

4. The fuel injector of claim 1, further including a leakage control feature comprising an annular channel disposed in an interior surface of said hydraulic link barrel and extending around said hydraulic link inner plunger to receive pressurized fuel.

5. The fuel injector of claim 1, further including an actuator plunger operatively connecting said piezoelectric actuator to said hydraulic link outer plunger, and a leakage control feature comprising an annular channel disposed in a surface of said injector body and surrounding said actuator plunger to receive pressurized fuel.

6. The fuel injector of claim 1, further including a hydraulic link return spring disposed between an end of said hydraulic link barrel and a surface of the hydraulic link outer plunger to provide a biasing force to said hydraulic link outer plunger.

7. The fuel injector of claim 1, further including a needle valve stop positioned longitudinally along said fuel injector between said hydraulic link assembly and said injector orifice to limit the movement of said needle valve toward said open position.

8. The fuel injector of claim 1, further including an actuator plunger operatively connecting said piezoelectric actuator to said hydraulic link outer plunger, said injector body including a bore positioned to receive said actuator plunger and a valve seat extending around said bore, said actuator plunger including a sealing valve adapted to move into a closed position when said stack of piezoelectric elements contracts in the second direction to block leakage flow into said bore and into a open position when said stack of piezoelectric elements expands in the first direction.

9. The fuel injector of claim 1, wherein said hydraulic link is positioned in a hydraulic link chamber, further including a hydraulic link refill valve operable to permit fuel into said hydraulic link chamber while preventing fuel flow from said hydraulic link chamber.

10. The fuel injector of claim 9, wherein said hydraulic link refill valve is positioned within said hydraulic link barrel.

11. The fuel injector of claim 10, wherein said hydraulic link refill valve includes a refill valve body mounted for slidable movement on said hydraulic link inner plunger and a valve seat formed on said hydraulic link barrel.

12. The fuel injector of claim 11, further comprising a refill valve stop formed on said hydraulic link inner plunger.

13. The fuel injector of claim 1, further including an annular gap positioned radially between said hydraulic link barrel and said injector body for receiving high pressure fuel.

14. The fuel injector of claim 1, wherein said hydraulic link barrel is biased in one axial direction by a return spring, and movable transversely.

15. The fuel injector of claim 1, further comprising a valve chamber formed in said hydraulic link outer plunger and a valve positioned in said valve chamber to restrict fuel flow out of said valve chamber to restrict movement of said needle valve in the second direction.

16. A piezoelectric-actuated fuel injector for injecting fuel into a combustion chamber of an internal combustion engine, comprising:

an injector body containing an injector cavity and an injector orifice communicating with one end of said injector cavity to discharge fuel into the combustion chamber;

a needle valve positioned in one end of said injector cavity adjacent said injector orifice, said needle valve movable between an open position in which fuel flows from the fuel supply circuit through said injector orifice into the combustion chamber and a closed position in which fuel flow through said injector orifice is blocked;

a piezoelectric actuator including a stack of piezoelectric elements movable to expand in a first direction and movable to contract in a second direction opposite said first direction;

a hydraulic link assembly disposed within said injector cavity and including a hydraulic link barrel having an inner bore and an outer surface radially spaced from said injector body to form an annular gap between said outer surface and said injector body to receive high pressure fuel, said hydraulic link assembly further including a hydraulic link outer plunger positioned to slidably move in said inner bore, operably connected to said piezoelectric actuator, and including a center bore, said hydraulic link assembly further including a hydraulic link inner plunger attached to the outer end of said needle valve and extending into said center bore of said hydraulic link outer plunger, and a hydraulic link chamber positioned axially between said hydraulic link barrel and said hydraulic link outer plunger.

17. The fuel injector of claim 16, wherein said hydraulic link outer plunger, said hydraulic link inner plunger and said hydraulic link barrel positioned in overlapping relationship along the axial extent of the injector, said hydraulic link chamber containing a hydraulic link operatively connected to said needle valve to move said needle valve in said second direction toward said open position in response to movement of said stack of piezoelectric elements in said first direction.

18. The fuel injector of claim 16, further including a link leakage control feature comprising an annular channel disposed in an interior surface of said hydraulic link barrel and extending around said hydraulic link inner plunger to receive pressurized fuel, an actuator plunger operatively connecting said piezoelectric actuator to said hydraulic link outer plunger, and an actuator leakage control feature comprising an annular channel disposed in a surface of said injector body and surrounding said actuator plunger to receive pressurized fuel.

19. The fuel injector of claim 16, further including a hydraulic link refill valve operable to permit fuel into said hydraulic link chamber while preventing fuel flow from said hydraulic link chamber.

20. The fuel injector of claim 19, wherein said hydraulic link refill valve is positioned within said hydraulic link barrel.

21. The fuel injector of claim 20, wherein said hydraulic link refill valve includes a refill valve body mounted for slidable movement on said hydraulic link inner plunger and a valve seat formed on said hydraulic link barrel.

22. The fuel injector of claim 16, wherein said hydraulic link barrel is biased in one axial direction by a return spring, and movable transversely.

23. The fuel injector of claim 16, further comprising a valve chamber formed in said hydraulic link outer plunger and a valve positioned in said valve chamber to restrict fuel flow out of said valve chamber to restrict movement of said needle valve in the second direction.

* * * * *